United States Patent [19]

Dean

[11] Patent Number: 4,860,388

[45] Date of Patent: Aug. 29, 1989

[54] UNIFORM GARMENT

[75] Inventor: Tracy C. Dean, Odessa, Tex.

[73] Assignee: Paul Agnew, Odessa, Tex.

[21] Appl. No.: 241,218

[22] Filed: Sep. 7, 1988

Related U.S. Application Data

[62] Division of Ser. No. 88,283, Aug. 24, 1987, Pat. No. 4,791,681.

[51] Int. Cl.[4] ..... A41D 1/18; A41D 27/20

[52] U.S. Cl. ..... 2/247; 2/106

[58] Field of Search ..... 2/106, 108, 115, 74, 2/79, 94, 102, 247, 250, 253

[56] References Cited

U.S. PATENT DOCUMENTS

| | | | |
|---|---|---|---|
| 2,458,353 | 1/1949 | Decker | 2/250 |
| 2,617,103 | 11/1952 | Westgarth | 2/253 X |
| 2,642,576 | 6/1953 | Kotkes | 2/253 |
| 3,537,108 | 11/1970 | Daniels | 2/247 X |
| 4,006,494 | 2/1977 | Knoppel | 2/253 X |
| 4,334,326 | 6/1982 | Mallow | 2/250 X |
| 4,625,337 | 12/1986 | Zahn | 2/94 X |
| 4,637,075 | 1/1987 | Ingrisano et al. | 2/94 |
| 4,651,348 | 3/1987 | Swanson | 2/94 X |

*Primary Examiner*—H. Hampton Hunter

*Attorney, Agent, or Firm*—Milburn, Hudman & Peterson

[57] ABSTRACT

A health care personnel blouse of light-weight material including a pocket which is designed for holding pens, scissors, and the like normal to activities of health care personnel. The pocket is orientated in such a position as to be aligned with the fold of the groin of the wearer so that articles in the pocket when the wearer is bending over remain within the contours of the natural bend of the body, thereby preventing items from poking into the wearer or falling out of the pocket. Also, the pocket has a reinforced bottom to provide extended use of the garment even though it is of light-weight construction.

3 Claims, 2 Drawing Sheets

UNIFORM GARMENT

This is a division, of application Ser. No. 88,283 filed 8-24-87 now U.S. Pat. No. 4,791,681 issued 12-20-88.

DESCRIPTION

TECHNICAL FIELD

This invention relates to a uniform garment in the health care field of durable, light-weight construction. The invention provides for carrying the necessary complement of articles utilized in providing health care service in a convenient and readily accessible manner without interference with the wearer's routine activities.

BACKGROUND INFORMATION

Numerous uniform-type garments are disclosed in the prior art adapted and designed to the needs of users such as nurses, orderlies, operating room personnel and others in the health care field. For example, U.S. Pat. No. 2,642,576 describes a pocket structure for a nurse's uniform or other garment for receiving scissors and pens in a pocket of a garment in the usual locations for pockets. The pockets in this particular structure receiving a pen or scissors are on the outer pocket and are exposed such that they could catch on various items such as beds, tables and the like which a nurse would encounter in routine duties and thus catching the uniform on something and possibly ripping it. Likewise, the pockets are vertical causing the articles to perhaps fall out of the pocket when a nurse bends over to pick up something off the floor or bends over a patient's bed as a result of pressure from the legs. Also, this may cause objects in the pocket to poke through the front of the material or seamline. Another vest-type garment is described in U.S. Pat. No. 4,637,075 for use by a medical technician which provides ready access to numerous articles which an EMS person may require in performing services. However, it suffers some of the deficiencies alluded to previously by having ready access but also exposure to catching on various items in the performance of activities inherent with health care service personnel. The disadvantages of the garments heretofore described are overcome in the present invention by the arrangement of the pockets and the closures used to provide ready access and avoid inadvertent contact with foreign objects causing the pockets to rip or the articles to fall out.

In the present invention, the scissor and pen pocket is designed to extend along the fold of the groin of the wearer so that bending and stooping action will not permit the articles to be pushed or fall out of the pocket. The bottom of the pocket is reinforced to prevent damage from the articles being carried therein and is hidden from the front of the garment by an additional pocket which has a smooth closure such as pile and hook or a zipper. In addition, the uniform garment provides a security attachment for retaining keys and the like such as narcotic keys in the wearer's possession to prevent loss or inadvertent misplacing of the articles. Further, the blouse is designed with an outer pocket extending across the entire front of the uniform which permits the wearer to move into close engagement with a bed or a patient without articles protruding from the pocket which would cause injury to either the wearer or the patient. In addition, the pant pockets are on the sides of the pant legs rather than being in front or behind the wearer to avoid the problem of bulky items and preventing the wearer from moving into close engagement to a patient's bed or wheelchair or patient as required in their normal activities.

DISCLOSURE OF THE INVENTION

In order to overcome the difficulties of the prior uniform garments, the present invention provides a highly improved uniform for personnel in the health care field such as nurses in general service, operating room personnel, critical care unit personnel, and the like.

The blouse or top of the uniform garment of the present invention includes a breast pocket having a hook and pile closure or zipper at the top and a reinforced bottom of the pocket. Extending substantially the full width in the front of the blouse along the hem is pocket panel reinforced at the hem of the blouse and extending upwardly some length and then inwardly towards the top edge of the panel to provide slant openings at either side of the panel. A vertical center seam divides the panel and forms two pouch pocket compartments on either side of the front of the garment. The slant openings are provided with closures such as hook and pile for ready access. One of the two pocket compartments has an inner pocket which is aligned along the fold of the wearer's groin and has a reinforced bottom and top opening such that scissors, pens and other articles handy to a wearer can be readily placed in the inner pocket without protruding through the bottom of the pocket and will remain therein without falling out of the pocket during the normal bending and stooping activities of the wearer. The other pocket compartment provides a loop for detachably attaching a keyring or the like for keys such as keys to narcotic cabinets which must be retained by the nurse in her possession at all times and by being attached to the internal pocket compartment cannot be inadvertently dislodged or mislayed by the person using the same. This loop also serves to prolong the life of the garment by reducing wear from the present practice of using a safety pin to secure keys to narcotic cabinets on the front of the shirt.

The pant of the present invention is designed with two pockets on either side of the pant centered on the outer border or seam of each pant leg at a convenient distance from the waist. The pockets have a reinforced bottom seam and expandable pleat on a vertical line with the pant leg with an opening at the top having a suitable hook and pile closure. Either or both pockets include an inner pocket in the front half of the outer pocket about two-thirds of the depth of the outer pocket. To provide a more versatile fit for the many sizes of people, the waistband has an elastic back portion and a fixed drawstring which may be secured around the waist of the wearer.

It is therefore an object of the present invention to provide a new uniform garment having pockets for carrying articles such as scissors, pens and the like in a manner which provides ready access without the inherent difficulty of sticking in the individual wearer or patient attended by the wearer and will not fall out of the pocket or be disgorged from the pocket by routine activities of the wearer, hence prolonging the life of the garment by reducing wear and tear.

It is another object of this invention to provide a loop internal to a garment pocket for detachably attaching a ring or key for security but permitting ready access to the user.

It is another object of the invention to provide a pant suit uniform of light-weight and durable construction with pockets having reinforced bottoms and an outer pocket extending the full width of a front of a blouse or top with slant openings that readily permits accessibility to the pocket interior with smooth closures which conceal and contain articles in a manner to avoid injuries to the wearer or to a patient in close engagement to the wearer.

It is another object of the invention to provide a uniform of light-weight and durable construction with readily accessible pockets which do not interfere with the routine activities of the wearer, provide ready access to articles placed in the pockets and prevents inadvertent dislodgement of articles placed therein.

Other objects, features and advantages of the invention will be readily understood from the following detailed descriptions set forth in connection with the following specification and accompanying drawing.

THE BEST MODE FOR CARRYING OUT THE INVENTION

Figure 1:
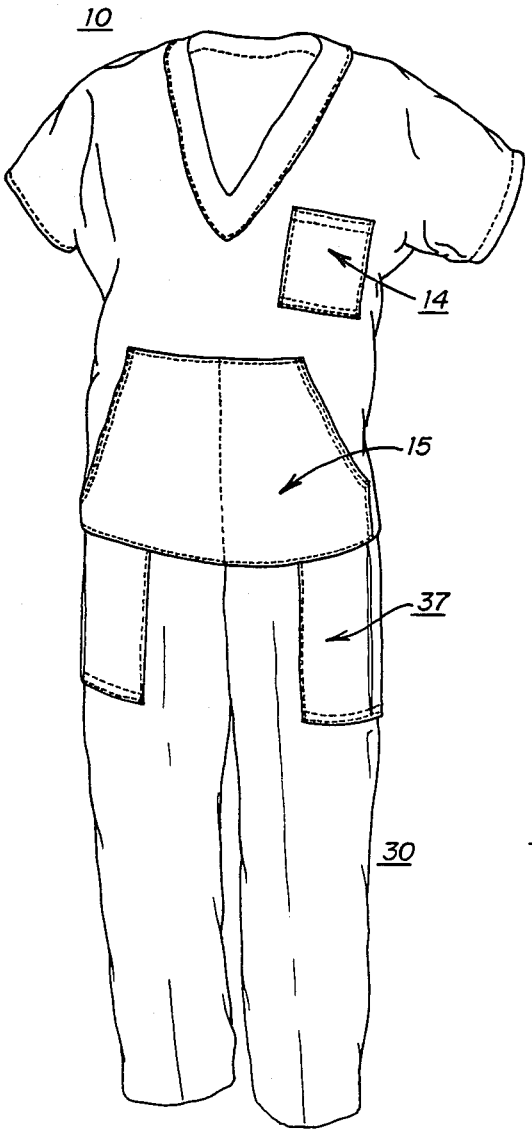
FIG. 1 is a perspective view illustrating the uniform garment blouse and pants including the outer pockets.
Figure 2:
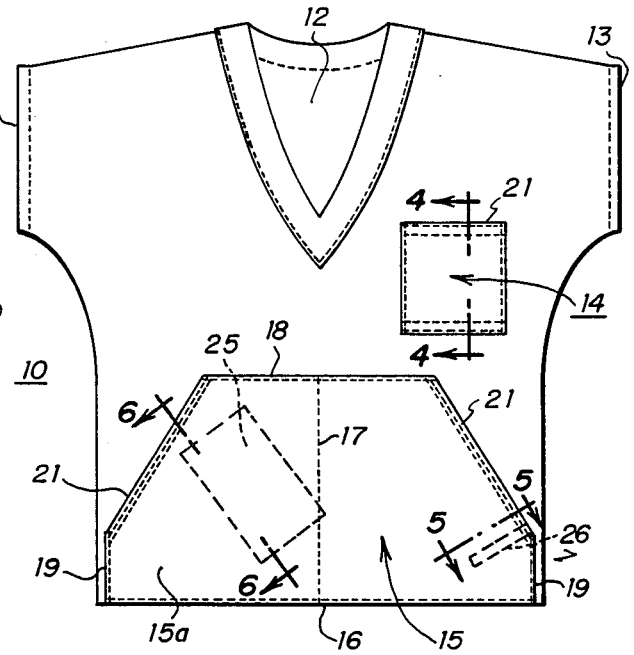
FIG. 2 is a front elevation view of the blouse illustrating the dual pouch pocket compartments of the blouse including the hidden inner pocket and hidden inner security loop.
Figure 3:
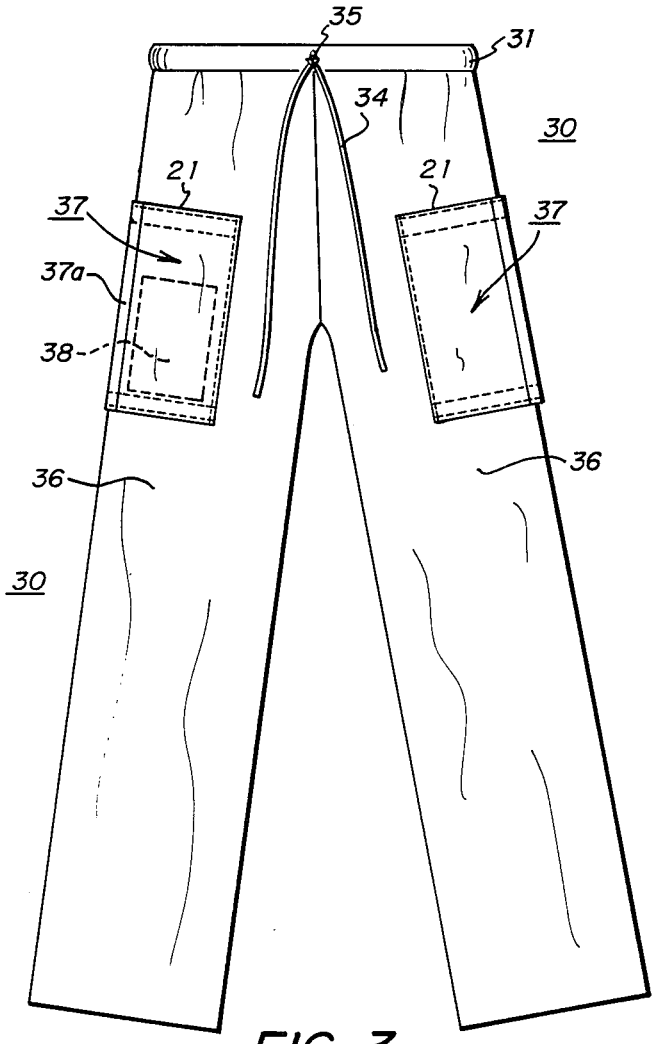
FIG. 3 is a front elevation view of the pant illustrating the drawstring portion of the waistband and the pleated leg pockets with the hidden inner pocket included.
Figure 4:
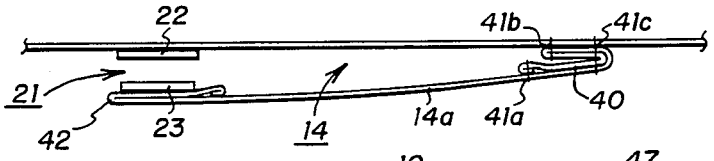
FIG. 4 is a cross-sectional view of the breast pocket illustrated in FIG. 2 detailing the hooks and pile closure.
Figure 5:
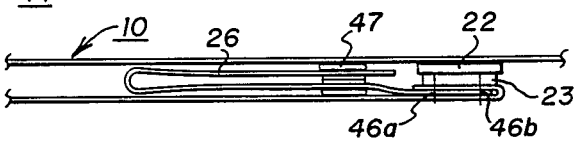
FIG. 5 is a cross-sectional view of the pouch pocket compartment illustrating one form of the inside security loop.
Figure 6:
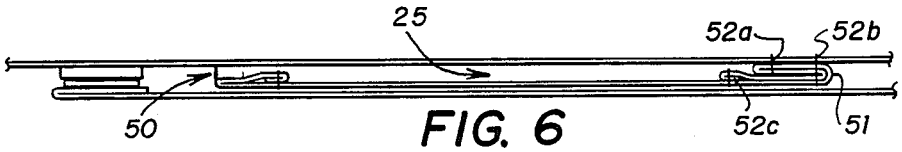
FIG. 6 is a cross-sectional view of the hidden inner pocket aligned with the fold of the groin as depicted in FIG. 2.
Figure 8:
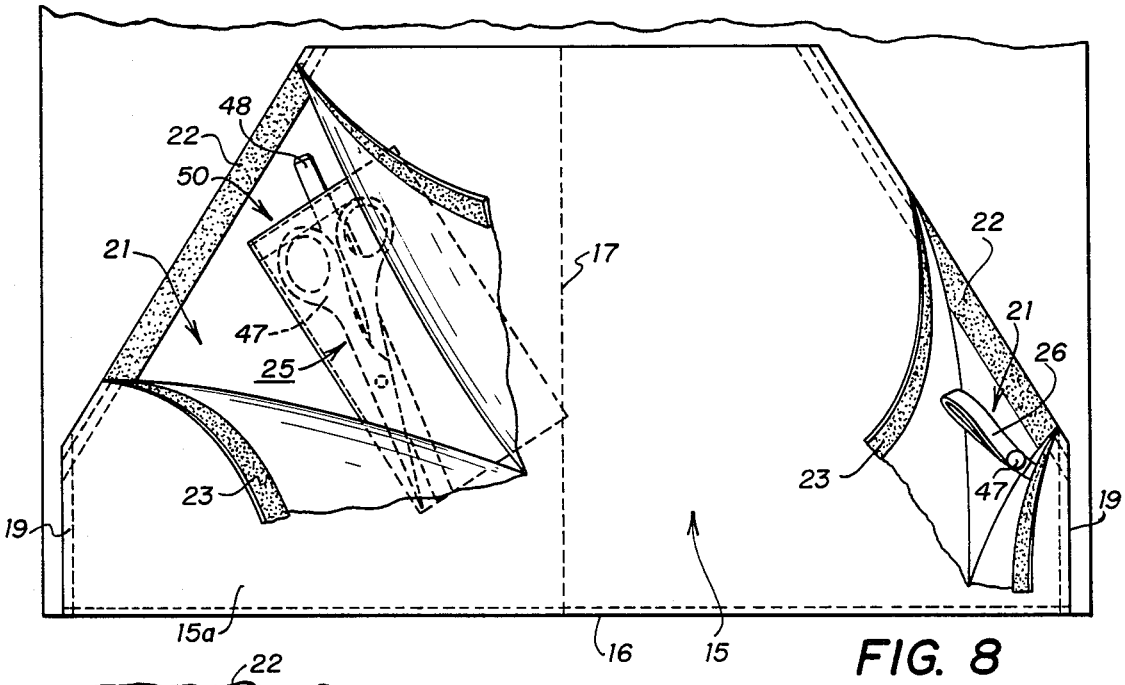
FIG. 8 is a partial view of the blouse in FIG. 2 illustrating the main pocket cut-away to illustrate the security loop, the hidden inner pocket with a pen and scissors therein, and the pile and hook closure for the pockets.
Figure 7:
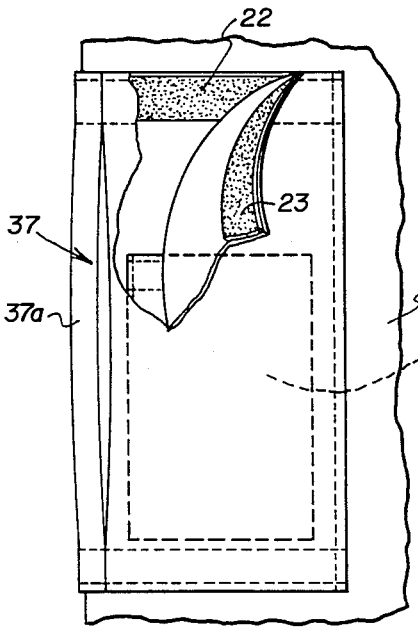
FIG. 7 is a partial view of the pant illustrated in FIG. 3 showing the hook and pile closure for the expandable pocket and part of the inner pocket.
Figure 9:
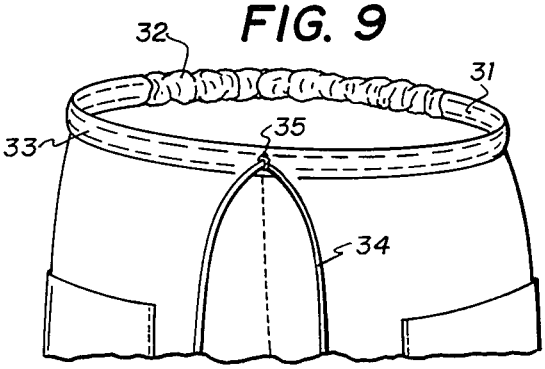
FIG. 9 illustrates in perspective a partial view of the top of the pants illustrating the elastic band and drawstring waistband.

A uniform garment for health or medical care personnel according to the invention is illustrated in FIGS. 1, 2 and 3 with detailed views in FIGS. 7, 8, and 9. Cross-sectional views illustrating the alignment of the pockets and the internal features are illustrated in FIGS. 4, 5 and 6. The uniform blouse or top 10 is formed with a neck opening 12 and sleeves 13. The sleeves 13 are illustrated as short sleeves but this could be a longer sleeve depending the particular desires of the user. Likewise, the neck opening is V-shape, but could be of other conventional forms. The blouse 10 is made of relatively light-weight material. The blouse includes a breast pocket 14. A pouch pocket 15 extends across the full width of the front of the blouse along the hemline 16 and is formed with a central seam or stitch line 17 extending vertically from the hem of the blouse to the top or upper edge or seam 18 of the pouch pocket 15 thereby providing two pouch pocket compartments. The upper edge or seam 18 extended horizontally less than the width of the blouse 10. Side seams 19 extend vertically upward to provide the pocket with some depth below the pocket openings. Front panel 15*a* of the pouch pocket 15 extends diagonally inward from the side seams 19 to the upper edge or seam 18 forming the pocket entrance 21 for each pouch pocket compartment. Internal to the pouch pocket 15 is an inner or hidden pocket 25 aligned along the natural fold of the groin of the wearer. A hidden security loop 26 is attached to the internal edge of pocket opening 21 of front panel 15*a*.

Referring now to FIGS. 3 and 9, a pant 30 is shown with a waistband 31 having an elastic back portion 32 and a front portion 33 with an internal drawstring 34 extending from the elastic portion 32 to the front opening 35 where the drawstring 34 exits exposing a sufficient portion of its length such that the wearer can draw the drawstring to the appropriate tightness and tie it. Each pant leg has an expandable pocket 37 with expandable pocket panels 37*a*. The pocket panels 37*a* are located such that they uniformly straddle the outer side of the pant leg forming the expandable pocket 37. Expandable pocket 37 includes an inner or hidden pant pocket 38.

For purposes of illustrating the reinforced bottoms of the pockets, reference is made to FIG. 4 which is a cross-sectional view of breast pocket 14. The breast pocket panel 14*a* has a reinforcing strip 40 which is stitched to itself at stitch line 41*a*. The reinforcing strip 40 is stitched to pocket panel 14*a* and blouse 10 at stitch line 41*b* and 41*c* thereby maintaining a double thickness for the bottom to pocket 14. Pocket entrance 21 has a closure comprised of hook material strip 22 attached to blouse 10 and pile material strip 23 attached to the double folded top 42 of breast pocket panel 14*a*. The hook material strip 22 and the pile material strip 23 form a quick release closure well known in the art marketed under the trademark Velcro as described in U.S. Pat. No. 3,537,108. The closure construction of pocket opening 21 described in connection with breast pocket 14 is identical with respect to pocket entrances or openings 21 of pouch pocket 15 and pant pockets 37 as illustrated in FIGS. 7 and 8. Referring now to FIGS. 5 and 8, a loop 26 is secured to front panel 15*a* inside pouch pocket 15 along stitch lines 46a and 46*b* which also secures the pile 23 to front panel 15*a*. Loop 26 has a snap fastener 47 which may be opened or closed to permit attachment of a key or keyring within the loop 26 for security purposes.

Referring to FIGS. 6 and 8, inner pocket 25 is illustrated which has an orientation whereby the length of the pocket is aligned with the fold of the wearer's groin. Inner pocket 25 is illustrated in FIG. 8 as containing a pen 48 and a pair of scissors 49. The hidden pocket 25 entrance 50 does not have a closure 22 and 23 since it is entirely enclosed within pouch pocket 15. The alignment with hidden pocket 25 to pouch pocket opening 21 is such that inner pocket 25 is readily accessible when the pouch pocket 15 is open. Inner pocket 25 has a reinforcing strip 51 which is similar to pocket bottom 40 of breast pocket 14 and is double stitched to the body of blouse 10 at stitch lines 52*a* and 52*b* and is stitched to itself along stitch line 52*c* thereby providing a reinforced bottom to hidden pocket 25. Pouch pocket 15 has a similar double fold reinforced bottom integral with the hemline 16. Referring now to FIG. 7, pant pocket 37 illustrates the hook material strip 22 and pile material strip 23 closure in a tear away view that exposes part of inner pocket 38. The construction of inner pocket 38 is similar to the construction of hidden or inner pocket 25 including a reinforcing strip to reinforce bottom 55 of inner pant pocket 38.

Again referring to FIGS. 6 and 8, inner pocket 25 is illustrated which has an orientation whereby the length of the pocket is aligned with the fold of the wearer's groin. As illustrated in FIGS. 6 and 8, inner pocket 25 is contained within pouch pocket 15. It will be appreciated that inner or hidden pocket 25 may be an outer pocket and will be positioned in the same orientation as illustrated in FIGS. 2 and 8. It will be appreciated that whether this particular pocket is an inner pocket or an outer pocket, the design of the pocket is to extend along the fold of the groin of the wearer so that the normal activities of the wearer in bending or stooping will not permit the articles to be pushed or fall out of the pocket or poke through the front of the material of the pocket as a result of pressure from the legs of the wearer.

What I claim is:

1. A pocket structure for a nurses' uniform blouse or the like comprising a pocket panel having a lower edge, an upper edge and two opposing parallel side edges, said pocket panel oriented along a line which is coextensive with the fold of the groin of the wearer, said pocket panel attached at its side edges and lower edge to the front of said uniform blouse.

2. A pocket structure for a health care personnel blouse or the like comprising a pocket panel having a lower edge, an upper edge and two opposing parallel side edges, said pocket panel oriented along a line which is coextensive with the fold of the groin of the wearer, said pocket panel attached at its side edges and lower edge to the front of said health care personnel blouse, thereby forming a pocket with the upper edge providing the entrance thereto.

3. The pocket structure of claim 2 wherein said pocket is concealed within an outer pocket on said health care personnel blouse.

* * * * *